US007487658B2

(12) United States Patent
Akishev et al.

(10) Patent No.: US 7,487,658 B2
(45) Date of Patent: Feb. 10, 2009

(54) DEVICE FOR SHEET MATERIAL CORRUGATION

(75) Inventors: Niaz Irekovich Akishev, Kazan (RU); Ildus Muhametgaleevich Zakirov, Kazan (RU); Alexandr Vladimirovich Nikitin, Kazan (RU)

(73) Assignees: Airbus, Blagnac (FR); Otkrytoe Aktsionernoe Obschestvo "Kazansky Nauchno-Isledovatelsky Institut Aviatsionnoi Tekhnologii", Kazan (RU)

( * ) Notice: Subject to any disclaimer, the term of this patent is extended or adjusted under 35 U.S.C. 154(b) by 212 days.

(21) Appl. No.: 10/581,368

(22) PCT Filed: Dec. 11, 2003

(86) PCT No.: PCT/RU03/00551

§ 371 (c)(1),
(2), (4) Date: Jun. 2, 2006

(87) PCT Pub. No.: WO2005/056208

PCT Pub. Date: Jun. 23, 2005

(65) Prior Publication Data

US 2007/0107485 A1 May 17, 2007

(51) Int. Cl.
*B21D 13/02* (2006.01)

(52) U.S. Cl. ..... 72/385; 72/38; 72/60; 425/396

(58) Field of Classification Search ..... 72/38, 72/54, 60, 61, 370.22, 379.6, 385; 425/89, 425/369, 388, 394, 396; 264/286, 505
See application file for complete search history.

(56) References Cited

U.S. PATENT DOCUMENTS 2,362,672 A * 11/1944 Sloan ..... 425/389
2,372,917 A * 4/1945 Tuttle ..... 72/62
3,179,726 A * 4/1965 Perry ..... 264/505
3,231,647 A * 1/1966 Oesterheld ..... 264/505
3,471,600 A * 10/1969 Meek ..... 264/505
3,971,243 A * 7/1976 Jones ..... 72/385

(Continued)

FOREIGN PATENT DOCUMENTS

RU 2 100 120 12/1997

(Continued)

*Primary Examiner*—Edward Tolan
(74) *Attorney, Agent, or Firm*—Oblon, Spivak, McClelland, Maier & Neustadt, P.C.

(57) ABSTRACT

The invention can be defined in its most general form as a device for sheet material corrugation by means of bending and can be used in production of light core for sandwich panels, and elements of heat-exchange apparatus. The device includes the pivotedly connected in-between shaping and auxiliary systems of dies (4) and the drive for their transformation including the system of vacuumization and the chamber (3) made of flexible gas-proof material where the latter of said systems is fixed. Used to set the system of shaping dies (4) into its initial plane state is the mechanism made in the form of rigid chamber with the perforated cap (2) providing the possibility to connect the chamber to the system of vacuumization. The device also includes the subsidiary flexible removable vacuum chamber (8) wherein the blank (6) from sheet material is placed in contact with the shaping system of dies (4). Said chamber and the transformation drive chamber have a common wall rigidly connected to the shaping and auxiliary systems of dies (4) at locations of their pivot connection.

7 Claims, 2 Drawing Sheets

U.S. PATENT DOCUMENTS

| | | | | |
|---|---|---|---|---|
| 3,992,162 | A | 11/1976 | Gewiss | |
| 4,008,591 | A * | 2/1977 | Vos et al. | 72/38 |
| 5,626,051 | A * | 5/1997 | Sabin | 72/379.6 |
| 2007/0098835 | A1 | 5/2007 | Akishev et al. | |
| 2007/0107485 | A1 | 5/2007 | Akishev et al. | |
| 2007/0141376 | A1 | 6/2007 | Akishev et al. | |

FOREIGN PATENT DOCUMENTS

| | | |
|---|---|---|
| RU | 2 118 217 | 8/1998 |
| RU | 2 205 084 | 5/2003 |
| SU | 1 690 903 | 11/1991 |
| SU | 1 755 999 | 8/1992 |

* cited by examiner

DEVICE FOR SHEET MATERIAL CORRUGATION

TECHNICAL FIELD

The invention can be defined in its most general form as a non-cutting shaping of materials, namely a device for sheet material corrugation by means of bending.

BACKGROUND ART

Known is a device for zigzag crimp production including seesaw shaping elements placed on each side of the shaped material moving in the guides along the base (U.S. Pat. No. 3,992,162. Sheet with alternate protrusions and recesses.—Int. Cl.: B 32 B 15/00.-16 Nov. 1976).

The main short-coming of herein-presented device is the complexity of its structure, high labor expenditures for production of shaping elements, and the impossibility to produce zigzag crimp with large amplitude of zigzag lines.

Known is a device for sheet material corrugation including two systems of dies pivotedly connected to each other along all sides made of similar plane elements placed on each side of the blank and the drive for transformation of these systems from initial to final relief state appropriate to the form of ready-made article (Inventors' certificate no. 1,690,903 USSR, Int. Cl.: B 21 D 13/02. Device for sheet material corrugation.—Bulletin no. 42 of 19 Jul. 1989).

The main short-coming of herein-presented device is the poor quality of the corrugated article and the presence on the blank of removable afterwards allowances due to shift of crimp outlines regarding to the blank edges when transforming. The said short-coming is determined by unequal distribution of stresses onto the blank from the direction of the elements when shaping due to friction of the frame inner surfaces and plane shaping elements.

Known is a device for sheet material corrugation including the system of the upper and the lower dies installed in the frame on each side of the blank having the drive in the form of removable vacuum chamber, rigid form holders, the drive made in the form of power cylinders for raising the upper holder and the upper part of the frame (Inventors' certificate no. 1,755,999 RF, Int. Cl.: B 21 D 13/02. Device for sheet material corrugation.—Bulletin no. 31 of 23 Aug. 1992).

The main short-coming of herein-presented device is the complexity of its structure, high materials consumption, large quantity of operating movements, high labor expenditures for production of form holders, and the absence of the mechanism for setting of the shaping tooling into its initial state; it results in complex mutual placement of the form holders, the systems of dies and the blank wherefore it adversely affects the quality and the cost of ready-made article.

Taken as a prototype is a known device for sheet material corrugation (RF Patent no. 02118217, Int. Cl.: B 21 D 13/00, 27 Aug. 1998) including the systems of the upper and the lower dies transformable with the use of removable vacuum chamber formed by bag from gas proof material fixed on their outer surfaces while the systems of the upper and the lower dies include the primary and the auxiliary shaping systems of dies and a unit for the upper system of dies raising made in the form of frame including the lateral and the longitudinal guiding elements pivotedly connected with the upper systems of dies through sliding vertexes.

Device operation mode includes the following positions: raising of the preliminary stretched out tooling upper part systems of dies to extreme upper position, placement of the sheet blank into the bag onto the tooling lower part shaping system of dies, drawing down of the upper system of dies onto the blank and pressurization of the bag along the front edge with the use of sealing profiles, evacuating air from the cavity formed by the upper and the lower systems of dies and shaping of the article, disconnecting of the tooling from the vacuum line and depressurization of the bag, raising of the frame together with the upper system of dies removing of the blank from the bag, drawing down of the frame and the upper system of dies and simultaneous stretching out of the upper and the lower systems of dies to the initial position defined by the stops installed on the longitudinal guides of the frame.

The main short-comings of herein-presented device are:

- the accurate alignment and strict movements timing of the upper and the lower systems units along the full length are difficult to provide due to uncertain manner of frictional forces in the pivots and movable joints of the structure elements;
- the absence of the mechanism for setting the shaping tooling into its initial plane state resulting in inaccurate reproduction of the form and the dimensions of the tooling on the blank due to lack of their full reciprocal conjugation;
- the complexity of the structure and high materials consumption.

DISCLOSURE OF INVENTION

The invention has for its object to provide proper mutual placement of the blank and of the shaping tooling at all stages of the transformation, and reduction of materials consumption of the structure.

The technical result attained at executing of the claimed invention is the improvement of the corrugated article quality and reduction of efforts for their production.

The stated technical result is attained by that the device includes the pivotedly connected in-between shaping and auxiliary systems of dies, used for transformation of dies systems drive in the form of the chamber from flexible gas-proof material, the vacuumization system, the mechanism for setting the shaping system of dies into the plane state and the subsidiary removable chamber for placement of the blank in contact with the shaping system of dies made in the form providing the possibility to connect the chamber and the vacuumization system. The mechanism for setting the shaping system of dies into the plane state made in the form of rigid chamber with the plane perforated cap providing the possibility to connect the chamber cavity to the vacuumization system and atmosphere. The subsidiary removable chamber made in the form of the bag from gas-proof material having a common wall with the transformation drive chamber form the side of the shaping system of dies while the common wall of the chambers is rigidly connected to the shaping and auxiliary systems of dies at locations of their pivot connection.

The undertaken by the applicant state of the art analysis shows that there are no analogs characterized by the combination of the features identical to those of the invention. Therefore, the claimed technical solution satisfies the "novelty" condition of patentability.

The results of retrieval for the known solutions in the given area with the aim to reveal the features identical with distinctions of the claimed technical solution show that its features do not result from the state of the art. From the defined state of the art the applicant managed to reveal no influence of the specified essential features upon the attainment of the stated technical result. The claimed technology, therefore, satisfies the "inventive step" condition of patentability.

BRIEF DESCRIPTION OF DRAWINGS

The FIGS. 1-3 present the essence of the invention.

Figure 1:
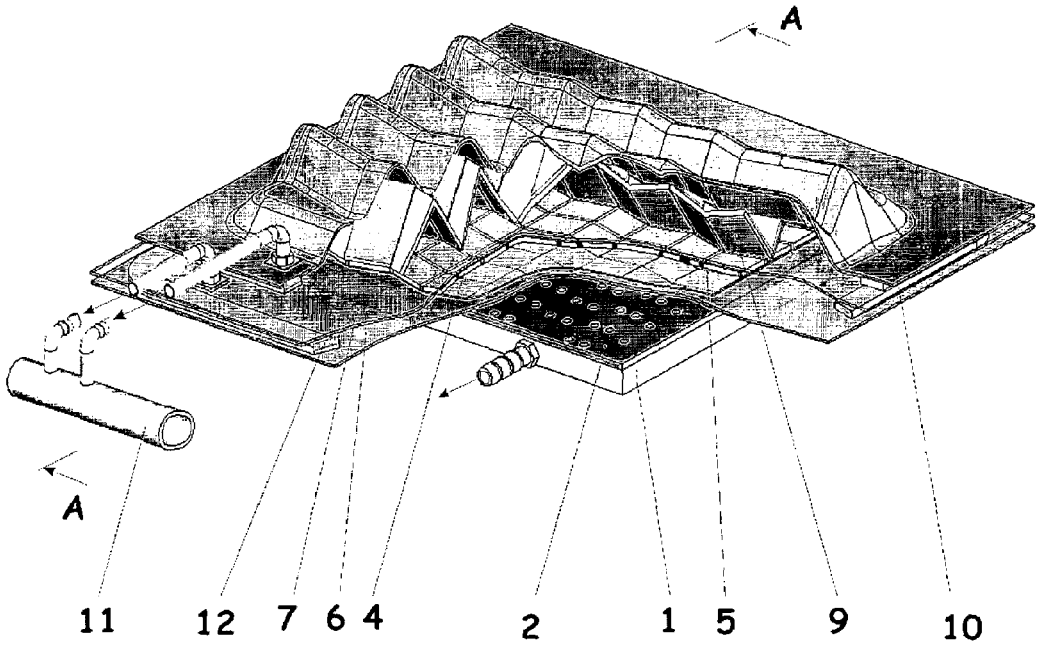
FIG. 1 is a general view of the device with a partial sectional elevation.
Figure 2:
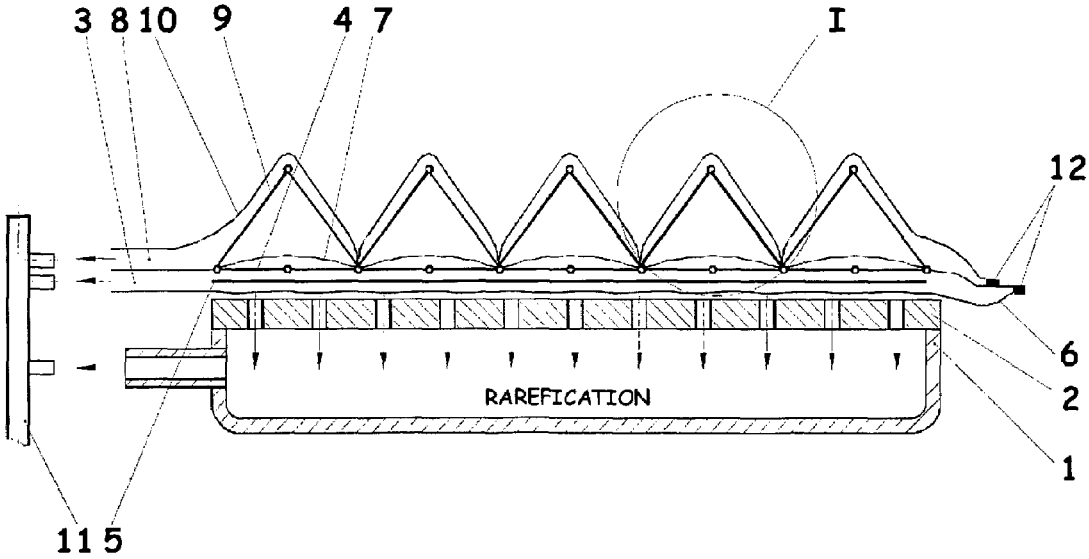
FIG. 2 is a sectional view A-A of FIG. 1 (layout of the device in its initial position)
Figure 3:
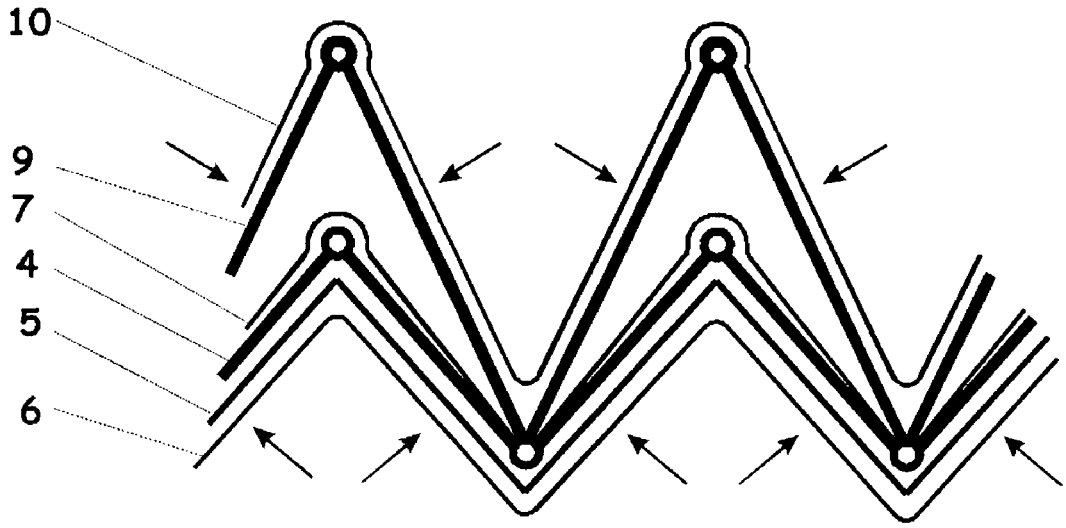
FIG. 3 is a fragment of the dies systems in the process of sheet material corrugation.

The FIGS. 1-3 present the following positions:

is the base; 2 is the perforated cap; 3 is the vacuum chamber-bag of the shaping dies system; 4 is the shaping dies system; 5 is the core sheet blank; 6 is the lower part of the vacuum chamber 3; 7 is the upper part of the vacuum chamber 3; 8 is the vacuum chamber-bag of the auxiliary dies system; 9 is the auxiliary dies system; 10 is the upper part of the vacuum chamber 8; 11 is the vacuum line; 12 is the sealing cord.

FIG. 1 presents the general view of the device. The device includes the base 1 in the form of rigid chamber with perforated cap 2. Installed on the base 1 is the vacuum chamber-bag 3 wherein are the shaping system of dies 4 and the core sheet blank 5. Vacuum chamber-bag 3 consists of two parts: the lower 6 and the upper 7 disposing of the possibility to be totally connected in-between along the edges with the use of sealing cord 12. Located on the vacuum chamber-bag 3 is the auxiliary system of dies 9. The shaping system of dies 4 and the auxiliary system of dies 9 are pivotedly connected in-between along the dies (shaping elements) edges regarding every second bending zigzag line. At the same time at locations of their pivot connections both systems of dies are rigidly connected with the upper part 7 of the chamber-bag 3. On the outside along the same pivots the auxiliary system of dies 9 is connected with the upper part 10 thus forming the vacuum chamber-bag 8. The parts 7 and 10 are totally connected in-between along the edges outside the system of dies with the use of sealing cord 12. The chambers 3 and 8 and the cavity of the base 1 possess the opportunity to be connected to the vacuum line 11.

BEST MODE FOR CARRYING OUT THE INVENTION

At the first stage the lower part 6 of the vacuum chamber-bag 3 is put onto the cap 2 of the base 1. Then, the core sheet blank 5, the shaping system of dies 4 and pressurized vacuum chamber-bag 8 are consecutively put onto the lower part 6 of the vacuum chamber-bag 3. At the next stage the vacuum chamber-bag 3 is pressurized along the edges with the use of sealing cord 12 and is connected to the vacuum line 11. After that, the chamber 3 is vacuumized wherewith connecting the base 1 cavity with the vacuum line 11 the rarefaction is generated under the lower part 6 of the chamber-bag 3 owing to evacuating air through the perforations in the cap 2. Consequently, provided are the alignment of the sheet blank 5 regarding to the shaping system of dies 4 and putting of this system with the blank 5 as a single whole into the plane state owing to clasping of the chamber-bag 3 to the cap 2 of the base 1.

Hereafter the vacuum chamber-bag 8 is connected with the vacuum line 11, at the same time disconnecting the base 1 cavity from the vacuumization system and connecting with the atmosphere. Herein the inner cavity volume of the of the chamber-bag 8 is decreased owing to inside and outside differential pressure; it results in simultaneous transformation of the auxiliary 9 and shaping 4 systems of dies. The plane elements of the shaping system of dies 4 influence the core sheet blank 5 whereupon it acquires the relief shape. The vacuum chamber-bag 3 is then depressurized and the ready-made core article is removed from the shaping system of dies. The device is ready for the next run.

INDUSTRIAL APPLICABILITY

The invention can be used when creating technological equipment for production of sandwich panels light core used in aircraft construction, building units, and in production of heat-exchange apparatus elements.

The invention claimed is:

1. A device for corrugating a sheet of material comprising;

a first flexible chamber made of flexible gas-proof material and configured so as to receive said sheet of material;

a first die system inside said first flexible chamber, said first die system being formed of first dies pivotably joined to each other;

a second die system outside said first flexible chamber and formed of second dies pivotably joined to each other and further joined to a first plurality of said first dies and to said first flexible chamber at common pivot locations; and a vacuum system connected to draw a vacuum in said first flexible chamber.

2. The device of claim 1, further comprising an element with a planar outer wall, said first flexible chamber being against said planar outer wall.

3. The device of claim 2, wherein said element defines a rigid chamber connected to said vacuum system, such that said planar outer wall is between said rigid chamber and said first flexible chamber, wherein said planar outer wall defines perforations in communication with said rigid chamber such that, when said vacuum system draws a vacuum in said rigid chamber, said first flexible chamber, said first die system and said sheet of material are placed in a plane state against said planar outer wall.

4. The device of claim 1, further comprising a second flexible chamber made of flexible gas-proof material and configured so as to receive said second die system, wherein said vacuum system is connected to draw a vacuum in said second flexible chamber.

5. The device of claim 4, wherein said second flexible chamber has a common wall with said first flexible chamber.

6. The device of claim 5, wherein said common pivot locations are on said common wall.

7. The device of claim 1, wherein a second plurality of said first dies are pivotably joined to each other at locations other than said common pivot locations.

* * * * *